United States Patent [19]

Marti

[11] Patent Number: 4,573,615

[45] Date of Patent: Mar. 4, 1986

[54] FASTENING DEVICE FOR POURER PLUGS

[76] Inventor: Juan P. Marti, No. 89 Avde de Roma, Manlleu (Barcelona), Spain

[21] Appl. No.: 569,580

[22] Filed: Jan. 10, 1984

[30] Foreign Application Priority Data

Jan. 11, 1983 [ES] Spain ..... 269664[U]

[51] Int. Cl.[4] ..... B65D 5/72

[52] U.S. Cl. ..... 222/566; 215/324; 222/567

[58] Field of Search ..... 222/566, 567, 570, 563, 222/572, 574; 215/100 R, 324, 355

[56] References Cited

U.S. PATENT DOCUMENTS

| | | | |
|---|---|---|---|
| 1,197,981 | 9/1916 | Weber | 222/566 |
| 2,471,716 | 5/1949 | Bell | 222/570 |
| 2,591,354 | 4/1952 | Harris | 222/570 |
| 2,808,972 | 10/1957 | Flugge et al. | 222/566 |
| 2,866,581 | 12/1958 | Henchert | 222/566 |
| 3,434,627 | 3/1968 | Tebbutt | 222/566 |

*Primary Examiner*—Joseph J. Rolla
*Assistant Examiner*—Kenneth Noland
*Attorney, Agent, or Firm*—Flynn, Thiel, Boutell & Tanis

[57] ABSTRACT

A pourer plug assembly for a container, wherein a metal cover is fixed to the upper end of the container and defines a central opening therethrough. A flexible pourer plug is secured to the cover for closing the opening. The flexible pourer plug has a base ring which is positioned within the opening and is provided with an annular rim disposed therearound and projecting radially outwardly thereof. The cover, in surrounding relationship to the central opening, has a fastening flange which defines an inwardly opening groove in which is accommodated the fastening rim. The fastening flange has an upper inner edge which projects downwardly into a narrow ring-shaped slot which opens downwardly of the plug between the base ring and the rim.

4 Claims, 1 Drawing Figure

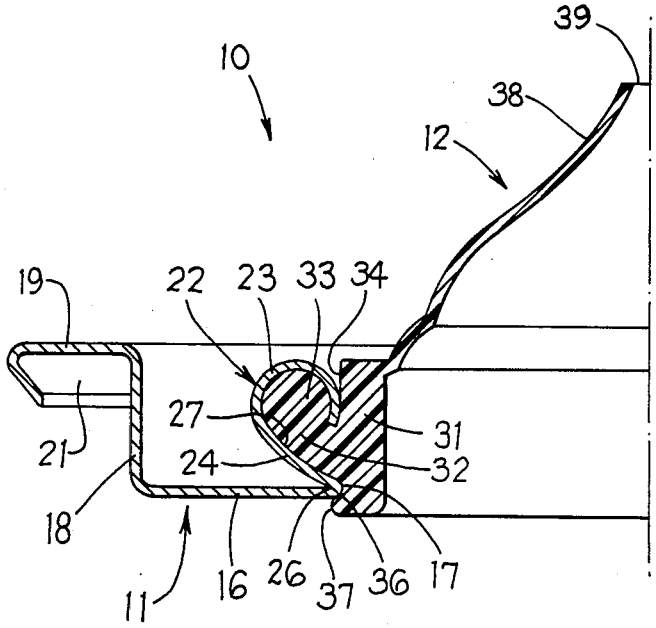
39
10
38
12
19
22
23
33
34
27
31
21
24
32
18
11
16
26
37
36
17

FASTENING DEVICE FOR POURER PLUGS

BACKGROUND OF THE INVENTION

This invention relates to a pourer plug assembly as utilized in association with a container or reservoir for permitting the pouring of liquid or product from the container and, more specifically, to an improved fastening structure which cooperates between the pourer plug and the cover of the container.

In the present invention, a conventional container such as a tin or can defining a reservoir for product therein is provided with a top wall defined by a metal cap or cover, the latter having an opening or orifice therethrough. A pourer plug of flexible material is secured to the cover to permit closing of the opening. The plug and cover have an improved fastening structure therebetween which results in the edge of the pourer plug being effectively concealed and securely connected to the cover.

In the improved assembly of this invention, the edge of the plug and the adjacent inner edge of the cover, which edges cooperate to define the fastening structure, have special configurations which cooperate to establish a solid and secure connection between the cover and plug, which connection is substantially leakproof and prevents accidental or undesired removal of the plug from the cover.

The arrangement of this invention generally includes an annular flange or bead which is integrally fixed to and projects outwardly from the base ring of the plug, which bead terminates in an upwardly projecting portion so that the bead and base ring define an upwardly opening ring-shaped groove therebetween. The cover, at its inner edge, has an annular flange which defines a radially inwardly opening groove, which flange snugly surrounds and embraces the annular bead on the plug. The cover flange has a free edge which projects downwardly into the ring-shaped groove defined in the plug to effect a secure connection therebetween. The securement of the cover flange onto and around the annular bead on the plug is accomplished by suitable tools.

The present invention will now be described in greater detail with reference to the attached drawing.

IN THE DRAWING

The sole FIGURE shows a fragmentary sectional view of the pourer plug assembly according to the present invention as taken substantially along a plane which passes through the central longitudinal axis of the assembly and projects radially outwardly thereof.

DETAILED DESCRIPTION

Referring to the drawing, there is illustrated a pourer plug assembly 10 according to the present invention, which assembly 10 is adapted to be mounted on the open upper end of a container (not shown), such as the upper end of a conventional paint or oil can. The plug assembly 10 includes a cover or top wall 11 for the container, and additionally includes a pourer plug 12 which is securely connected to the cover 11.

Considering first the cover 11, same is normally constructed of metal so as to be substantially strong and relatively rigid. The cover 11 normally has a configuration suitable so as to fit within the open end of a container, whereupon the cover will hence typically have a circular or rectangular profile when viewed from above so that the cover profile corresponds to the cross section of the container.

The cover 11 includes a substantially horizontal bottom wall 16 which defines a substantially circular opening or orifice 17 therethrough, which opening 17 provides access to the reservoir defined within the container on which the cover is mounted. The presence of this opening 17 within the bottom wall 16 results in the latter having a ringlike shape. Bottom wall 16, at its outer edge, terminates in an upwardly projecting annular sidewall 18, which sidewall 18 at its upper end terminates in an outwardly projecting channel-like flange 19. This latter flange 19 defines a downwardly opening groove 21 which encircles the sidewall 18. When the cover 11 is mounted on a container, the inner surface of the lateral sidewall of the container, adjacent the open upper end thereof, normally snugly surrounds the sidewall 18 so that the upper free end of the container projects into the groove 21. The cover 11 is normally fixedly secured to the container, such as by securing the flange 19 to the container in any conventional manner, as by riveting or soldering.

Cover 11 has, in surrounding relationship to the central opening 17, an annular fastening flange 22 which is integrally fixed to and projects upwardly from the radially inner edge of the bottom wall 16. This fastening flange 22 has an upper substantially semi-circular ring part 23 which opens downwardly and, at one side thereof, defines the free inner edge of the cover. The other side of this ring part 23 is integral with an intermediate part 24 which is substantially straight and slopes downwardly and inwardly so as to be integrally joined to the bottom wall 16 at an acute angle. The junction of intermediate part 24 and bottom wall 16 defines a substantially rounded noselike edge 26, which edge defines the circular opening 17. The annular fastening flange 22, having the configuration described above, defines an annular groove 27 which encircles the circular opening 17. This groove 27 has a generally L-shaped cross section in that it has a lower leg portion which opens radially inwardly for communication with said central opening 17, and an upper leg portion which projects upwardly and is bounded by the ring part 23.

Considering now the pourer plug 12, same is normally constructed of a flexible and deformable material, such as a plastics or rubberlike material. This plug 12 includes a ringlike base 31 which has a configuration resembling a cylindrical sleeve. This ringlike base 31 is dimensioned to fit within the cover opening 17. Base ring 31 has a ring-shaped fastening rim or bead 32 integrally fixed thereon and projecting radially outwardly therefrom in surrounding relationship thereto. This fastening bead 32 has an upper part 33 which is of a substantially semi-circular cross section so as to have an upper outer rounded profile. This rounded upper part 33 is spaced radially outwardly from the base ring 31 by means of a small slot or groove 34 which opens upwardly and encircles the ring 31.

As illustrated by the drawing, the base ring 31, in the outer periphery thereof adjacent the lower end, is provided with a shallow encircling groove 36 which accommodates therein the rounded edge 26 of the cover. The base ring 31 also has a small encircling flange 33 at the lower outer edge thereof which projects partially under the bottom wall 16 in the vicinity of the edge 26 to assist in creating a secure connection between the cover and plug. The groove 36 and flange 37 can be preformed on the plug 12, or in the alternative the plug 12 can be of a sufficiently elastically deformable material so that the outer diameter of ring 31 is slightly greater than the diameter of opening 17 whereupon the nose 26 will automatically create the relationship illustrated by the drawing.

The plug 12 has a truncated cone-shaped tube 38 which is integrally fixed to the upper end of the base ring 31 and is adapted to project upwardly therefrom when dispensing or pouring of product from the container is desired. This tube 38 terminates in a conventional pouring opening 39 at the narrow or free end thereof. This opening 39 is normally maintained closed by means of a removable clam (not shown) which is disposed in encircling relationship to the tube 38 for deforming and hence closing the tube. The tube 38 is of a thin wall construction so as to be readily flexible and deformable, and in fact the thickness of wall 38 is generally a small fraction of the radial thickness of the base ring 31. This flexibility of the tube 38 permits it, when closed, to be collapsed so as to be stored substantially within the interior of the base ring 31. The tube 38 is manually moved into the extended position illustrated in the drawing when pouring of product from the container is desired.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A pourer plug assembly for a container defining therein a product reservoir, said assembly comprising:

a cover for said container, said cover having means associated with the outer edge thereof for attaching the cover to the container, said cover defining a central opening therethrough;

said cover having a fastening flange fixed thereto in surrounding relationship to said central opening, said fastening flange defining therein an annular groove which opens radially inwardly for communication with said central opening;

said annular groove defined by said fastening flange having a substantially L-shaped cross section and including a first leg which projects radially outwardly from and communicates with the central opening, and a second leg which projects upwardly from the outer end of said first leg;

a pourer plug of a flexible material positioned within said central opening and securely connected to said cover;

said pourer plug having a base ring positioned within said central opening, and a fastening rim integrally fixed to said base ring and projecting radially outward therefrom into said annular groove, said fastening rim having a substantially L-shaped cross section compatible with said groove and including a bottom leg which projects outwardly from the base ring and terminates in an upwardly projecting leg which is spaced radially outwardly from said base ring by means of a ring-shaped slot therebetween which opens upwardly, said upwardly projecting leg having a rounded outer profile;

said fastening flange having a substantially semi-circular ring part thereon which partially and snugly encircles the upwardly projecting leg of said rim and projects downwardly into said ring-shaped slot for securely connecting said cover and plug together, said semi-circular ring part opening downwardly and defining therein the second leg of said groove, said ring part having a radially inner portion which defines the free edge of the cover and which projects into said ring-shaped slot; and said plug having a tubular pouring spout integrally connected to said base ring.

2. An assembly according to claim 1, wherein said cover has a substantially horizontal bottom wall which terminates in an inner edge which defines said central opening, and said fastening flange being fixedly and integrally joined to said inner edge of said bottom wall, said fastening flange including a substantially straight intermediate wall which is integrally fixed to said inner edge and projects upwardly and radially outwardly therefrom for integral connection with the outer side of said semi-circular ring part.

3. An assembly according to claim 2, wherein said bottom wall and said intermediate part merge together at an acute angle and define said inner edge of said cover, said inner edge projecting into a shallow groove which is formed in the exterior periphery of and externally surrounds said base ring adjacent the lower end thereof.

4. An assembly according to claim 3, wherein said tubular spout is of a truncated conical configuration and has a thin flexible wall, said thin flexible wall being substantially thinner than the radial thickness of said base ring, and said pouring spout having the end thereof of large diameter integrally joined to said base ring adjacent the upper end thereof.

* * * * *